United States Patent [19]

Hayes et al.

[11] Patent Number: 5,028,281

[45] Date of Patent: Jul. 2, 1991

[54] CAMSHAFT

[75] Inventors: William J. Hayes, Shelby; Harry A. Matrone, North Muskegon; Philip D. Johnson, Whitehall, all of Mich.

[73] Assignee: Textron, Inc., Providence, R.I.

[21] Appl. No.: 409,012

[22] Filed: Sep. 12, 1989

Related U.S. Application Data

[62] Division of Ser. No. 207,187, Jun. 14, 1988, Pat. No. 4,880,477.

[51] Int. Cl.[5] ..... C22C 37/10

[52] U.S. Cl. ..... 148/321; 148/902

[58] Field of Search ..... 148/138, 141, 3, 904, 148/902, 321; 74/567

[56] References Cited

U.S. PATENT DOCUMENTS

| | | | |
|---|---|---|---|
| 2,324,322 | 7/1943 | Reese et al. | 148/138 |
| 2,485,760 | 10/1949 | Millis et al. | 148/321 |
| 3,273,998 | 9/1966 | Knoth et al. | 148/323 |
| 3,549,430 | 12/1970 | Kies et al. | 148/323 |
| 3,549,431 | 12/1970 | De Castelet | 148/141 |
| 3,860,457 | 1/1975 | Vourinen et al. | 148/138 |
| 3,893,873 | 7/1975 | Hanai et al. | 148/12 R |
| 4,222,793 | 9/1980 | Grindahl | 148/141 |
| 4,541,878 | 9/1985 | Muehlberger et al. | 148/141 |

FOREIGN PATENT DOCUMENTS

| | | |
|---|---|---|
| 1164777 | 4/1984 | Canada . |
| 1200741 | 2/1986 | Canada . |
| 0065678 | 12/1982 | European Pat. Off. . |
| 2853870 | 7/1980 | Fed. Rep. of Germany . |
| 956203 | 4/1964 | United Kingdom . |

*Primary Examiner*—Deborah Yee

*Attorney, Agent, or Firm*—Varnum, Riddering, Schmidt & Howlett

[57] ABSTRACT

An austempered ductile iron alloy with a mixed austenitic-bainitic structure is made by a method which enables the iron to withstand high cyclical stresses while having a high resistance to abrasion. Articles such as automobile roller-follower camshafts that are made from the iron alloy may have portions thereof selectively austempered to reduce the overall cost and time required to manufacture the article.

24 Claims, 2 Drawing Sheets

CAMSHAFT

This is a division of application Ser. No. 207,187 filed June 14, 1988, now U.S. Pat. No. 4,880,477.

THE FIELD OF THE INVENTION

The invention relates to improved, ductile cast iron, composition and a process of making ductile iron machine elements such as camshafts which are able to withstand high cyclical loading with a high resistance to wear for portions thereof in rolling contact with other machine elements.

BACKGROUND OF THE INVENTION

Camshafts of a roller-follower type for engines such as those used in automobiles must be able to withstand high cyclical (i.e. Hertzian) stresses with little wear. Until the advent of the present invention, only roller-follower camshafts made from steel could successfully be used for high Hertzian stress applications.

Austempered cast iron materials of high strength and high resistance to abrasion are known. For example, U.S. Pat. No. 3,549,431 to De Castelet, issued Dec. 22, 1970; U.S. Pat. No. 3,860,457 to Vuorinen et al., issued Jan. 14, 1975; U.S. Pat. No. 4,541,878 to Muehlberger et al., issued Sept. 17, 1985; U.S. Pat. No. 3,893,873 to Hanai et al., issued July 8, 1975; U.S. Pat. No. 3,549,430 to Kies, issued Dec. 22, 1970; U.S. Pat. No. 2,485,760 to Millis et al., issued Oct. 25, 1949; U.S. Pat. No. 2,324,322 to Reese et al., issued July 13, 1943; and U.S. Pat. No. 3,273,998 to Knoth, et al., issued Sept. 20, 1966, disclose austempered cast iron compositions. However, each of the processes disclosed fails to yield a form of cast iron which has a hardness suitable for machine elements in rolling contact such as roller-follower camshafts and which is prepared in a time-efficient manner to reduce overall manufacturing costs. Nor do these prior patents disclose an efficient means by which it is possible to selectively austemper portions of an article, thereby reducing overall costs and manufacturing time.

Grindahl discloses a cast iron article in the form of a gear that provides high resistance to wear. However, the Grindahl process includes the step of holding the article at an austenitizing temperature for a time preferably in the range of 3.5 hours. Grindahl's article also undergoes a cold-working step as part of the process.

De Castelet discloses a cast iron which is austempered at a temperature that yields a hardness too low for articles so made to resist wear when in rolling contact. In addition, although De Castelet discloses that articles may have portions thereof heat-treated, he does not disclose an efficient means to accomplish such localized heat treatment.

SUMMARY

According to the invention, a camshaft made by process comprises casting an elongated shaft from a cast iron composition including, by weight 3.40% to 3.90% (preferably 3.50% to 3.80%) carbon, 1.90% to 2.70% (preferably 2.10% to 2.40%) silicon, up to 1.40% (preferably up to 0.30%) manganese, up to 1.5% (preferably 0.20% to 0.60%) molybdenum, up to 0.08% (preferably up to 0.05%) phosphorus and up to 2.0% (preferably 0.08% to 1.20%) copper.

The elongated shaft has a plurality of eccentric lobes spaced therealong. At least some of the lobes in non-austempered condition are selectively heated to a temperature in the range of 1500°-2000 ° F. to austenitize only surface portions of the lobes while maintaining the remainder of the shaft in non-austempered condition. Thereafter the heated lobes are quenched rapidly to a bainite transformation temperature to essentially prevent the formation of pearlite in the heated lobe portions and the quenched lobe portions are held at the bainite transformation temperature for a time sufficient to transform at least a substantial portion of the austenite into bainite while avoiding the formation of pearlite. Thereafter the quenched lobe portions are cooled to room temperature to transform some of the remaining austenite to bainite or martensite. By this process, the camshafts are formed with selectively hardened lobes.

Further according to the invention, at least portions of the unhardened remainder of the shaft are machined subsequent to austempering the lobe portions. Portions of the austempered lobes are ground after the austempering process.

The austenitizing temperature is preferably in the range of 1420°-2100° F. and the austenitizing time is preferably in the range of 1 second to 100 seconds. Further, the lobes are preferably quenched to the bainite transformation temperature within 180 seconds. The bainite transformation temperature is in the range of 450°-850° F., preferably in the range of 465°-485° F. The lobes can be held at the bainite transformation temperature for a time in the range of 10 minutes to 240 minutes, preferably 115-125 minutes. The delay between the heating and quenching steps is less than 60 seconds, preferably less than 10 seconds. The camshaft is also preferably cooled in air from the bainite transformation temperature.

The austempered lobes comprise a microstructure comprising by volume 25% to 75% bainite, 5% to 50% martensite, 5% to 50% unreacted low carbon austenite, approximately 10% graphite nodules, and less than 1% cementite.

Other objects, features and advantages of the invention will be apparent from the ensuing description taken in conjunction with the accompanying drawings.

DESCRIPTION OF THE PREFERRED EMBODIMENTS

Figure 1:
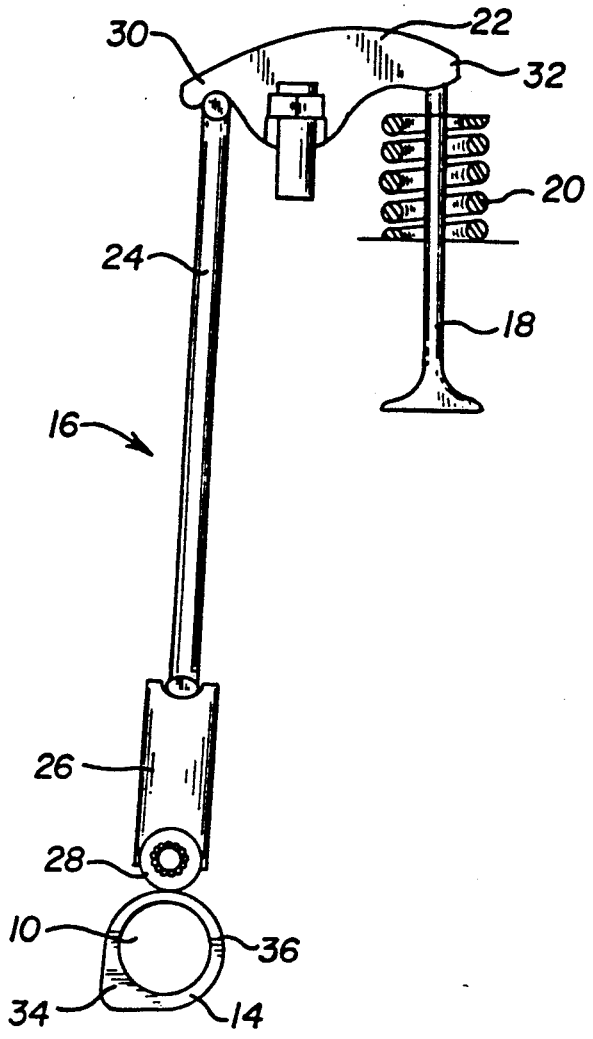
FIG. 1 is a schematic side elevational view of an engine pushrod valve gear mechanism having a roller lifter and including a roller-follower camshaft made with austempered ductile iron according to the present invention.
Figure 2:
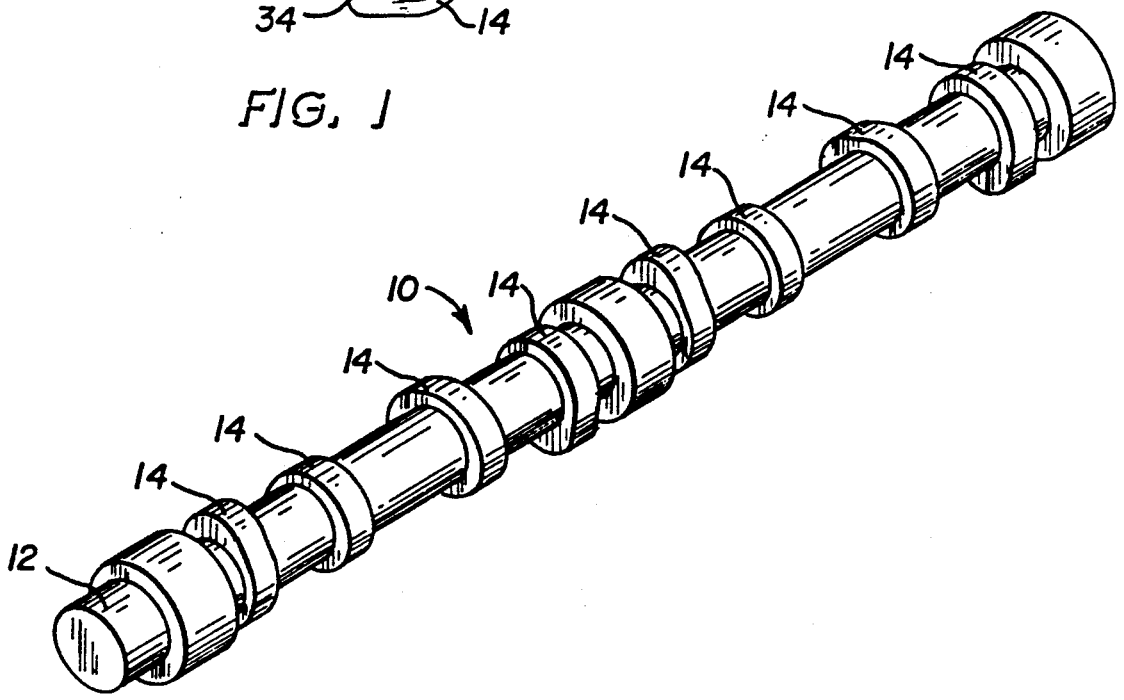
FIG. 2 is a perspective view of the camshaft of FIG. 1.

Referring to FIGS. 1 and 2, there is shown a roller follower camshaft 10 that is used in vehicles such as automobiles and having what are termed "roller lifter" engines. The camshaft comprises a body 12 and eccentric lobes 14.

The engine includes a pushrod valve gear mechanism 16 comprising a valve 18, valve spring 20, rocker arm 22, pushrod 24, roller follower 26, roller 28 and the camshaft 10. The roller 28 is rotatably mounted to the roller follower 26 and is in rolling contact with the camshaft lobe 14. The pushrod 24 is mounted to and between the roller follower 26 and a first side 30 of the rocker arm 22. The rocker arm is pivotally mounted with the valve 18 engaging a rocker arm second side 32. The valve is in registry with the engine cylinder head (not shown), so that reciprocating movement of the valve 18 will alternately open and close apertures (not shown) leading into the engine cylinder (not shown). Each cylinder of the engine has a plurality of associated valve gear assemblies.

As the camshaft 10 illustrated in FIG. 1 is rotated about its longitudinal axis by the engine, the camshaft lobe 14 initiates rotational motion in the roller 28. As the lobe eccentric portion 34 engages the roller, the roller follower 26 and pushrod 24 are driven upwardly relative to the figure. The pivoting action of the rocker arm 22 urges the valve downwardly as viewed in FIG. 1, thereby opening the aperture into the engine cylinder (not shown). This movement places the valve spring 20 in compression. As the lobe 14 continues to rotate and thereby to bring the lobe noneccentric portion 36 into engagement with the roller 28, the spring 20 will expand, driving the rocker arm 22 and valve 18 upwardly to thereby close the aperture. This opening and closing action completes one cycle for the valve gear mechanism 16. In an alternate embodiment (not shown), the follower 26 activates the valve 18 directly, without the use of a rocker arm.

Contact stress loads on the camshaft lobe 14 result primarily from the valve spring 20 expanding upwardly, causing the rocker arm 22 to urge the pushrod 24 downwardly and thereby cause the roller 28 to exert pressure on the camshaft lobe. This pressure induces cyclical stresses on the lobe 14 that, in conjunction with the rolling contact between the roller 28 and the lobe, causes the lobe to be susceptible to excessive wear. It is therefore important that the camshaft lobes 14 be made of a material that is highly resistant to wear when they are subjected to high cyclical (i.e., Hertzian) stresses. To perform successfully, the camshaft 10 must be able to withstand a Hertzian stress above 215,000 PSI. It has been found that a camshaft made of austempered ductile iron made according to the invention will meet this standard.

Austempering is a heat treatment wherein the iron alloy is: (1) heated to a temperature at which austenite forms (i.e., austenitizing the alloy); (2) quenched to an elevated temperature above which martensite forms; and (3) tempered at that temperature until a bainite microstructure comprising alternating layers of acicular ferrite and high carbon austenite is formed.

Figure 3:
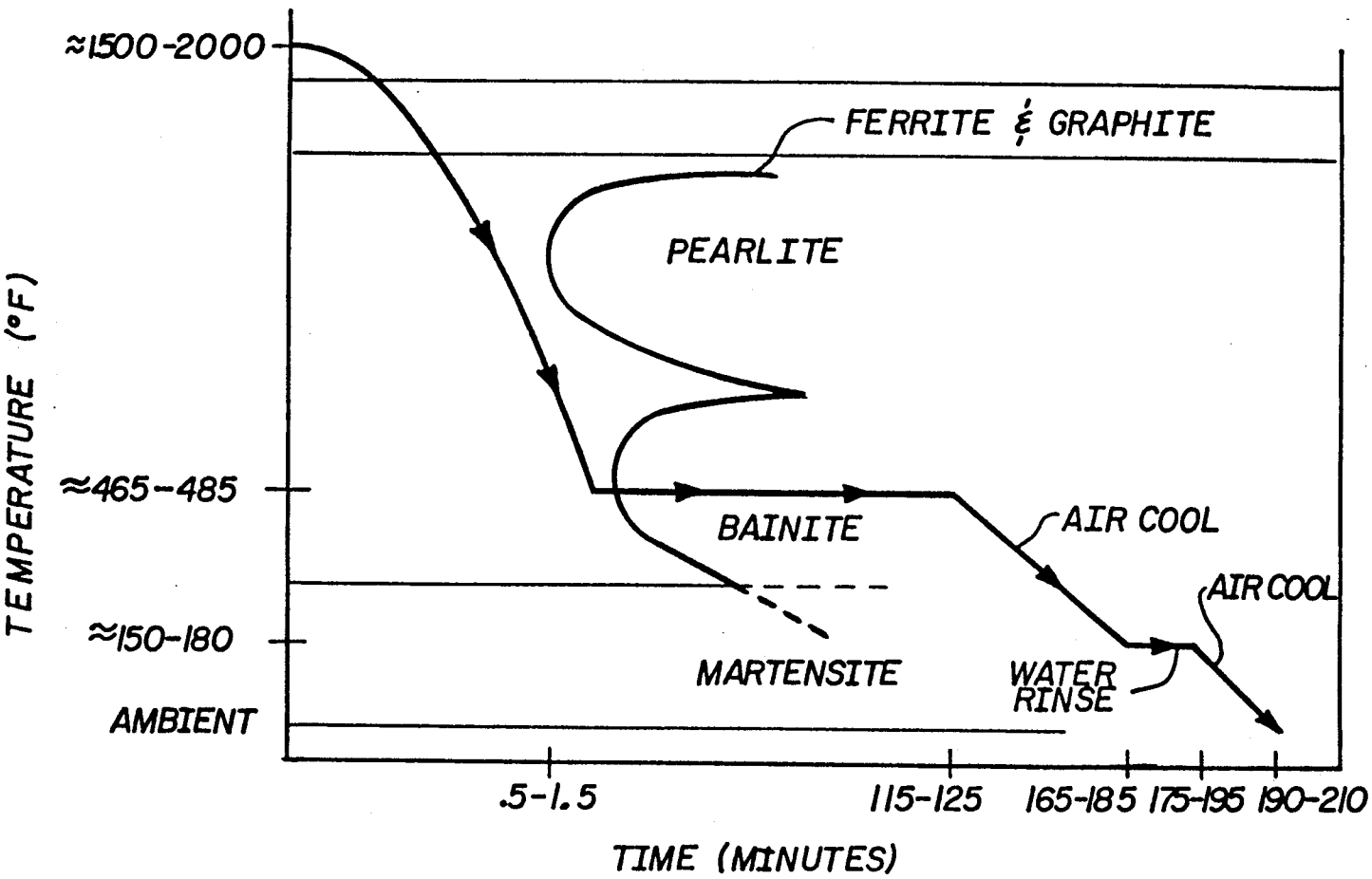
FIG. 3 is a time-temperature diagram showing the preferred process of heat treatment for an austempered ductile iron material processed according to the present invention.

The austempered ductile iron according to the invention is preferably manufactured in the following manner. The iron comprises an alloy containing the following percentages of alloying elements by weight:

Carbon (C): 3.40–3.90 (preferably 3.50–3.80)
Silicon (Si): 1.90–2.70 (preferably 2.10–2.40)
Magnesium (Mg): 0.030–0.065 (preferably 0.035–0.055)
Manganese (Mn): 0.00–1.40 (preferably 0.00–0.30)
Molybdenum (Mo): 0.00–1.50 (preferably 0.20–0.60)
Phosphorus (P): 0.00–0.08 maximum (preferably 0.00–0.05)
Sulfur (S): 0.00–0.05 maximum (preferably 0.00–0.02)
Nickel (Ni): 0.00–3.00 maximum (preferably 0.00–0.10)
Copper (Cu): 0.00–2.00 maximum (preferably 0.80–1.20)
Chromium (Cr): 0.00–0.50 maximum (preferably 0.00–0.10)
Aluminum (Al): 0.00–0.10 (preferably none)
Titanium (Ti): 0.00–0.10 (preferably none)
Tin (Sn): 0.00–0.20 (preferably none)
Iron (Fe): the remainder As seen in FIG. 3, to austemper the ductile iron, the alloy is heated to an austenitization temperature in the range of 1420° F. to 2100° F. (preferably 1500° F. to 2000° F.) for a period of one second to 8 minutes (preferably 30 seconds to 100 seconds for smaller articles and up to 8 minutes for larger articles). During this stage of the treatment, the microstructure of the article is transformed into austenite. The precise austenitization temperature is not critical because of the short time the article is in the austenitization range. After a delay of between zero seconds to 60 seconds (preferably one second to 10 seconds), the article is quenched in a salt bath comprising, for example, a mixture of sodium nitrite, sodium nitrate and potassium nitrate and tempered at a temperature in the range of 450° F. to 500° F. (preferably 465° F. to 485° F.). It is critical that the article avoid the pearlite knee shown in FIG. 3. If it enters the pearlite range, the strength, wear resistance and hardness of the article will be decreased. For this reason, the article must be quenched to the tempering temperature within 30 seconds to 180 seconds. An alternative quench medium may comprise an oil or a fluidized bed. The fluidized bed preferably includes a heated granular solid medium having a gas such as air blowing through the medium.

The article is tempered for a period between 10 minutes to 4 hours (preferably 115 minutes to 125 minutes). During this time, the article enters the bainite range, thereby transforming a portion of the microstructure into bainite. After tempering, the article is cooled by ambient air until it reaches a temperature of approximately 150° F. to 180° F. This typically takes 50 minutes to 60 minutes. Air cooling reduces the transformation of unreacted austenite into martensite. After the article reaches 150° F. to 180° F., it is placed in a water rinse having the same temperature. The water functions to rinse residual salt from the salt bath off the article. After rinsing, the article may be cooled by any convenient means such as air cooling to ambient temperature. Alternatively, for those applications in which the formation of martensite is not detrimental, forced air, an oil quench or a water quench can be used to cool the article after tempering.

As stated above, the microstructure obtained in the process comprises bainite (i.e., alternating layers of acicular ferrite and high carbon austenite). The microstructure also contains graphite nodules and can contain appreciable amounts of unreacted low carbon austenite (i.e. austenite that has not undergone the bainitic transformation) and martensite. The amounts of each microconstituent can vary widely depending upon austempering temperature, austempering cycle time and the chemical composition.

In the preferred embodiment for camshafts, the iron microstructure contains by volume, bainite in the range of 25% to 75%, unreacted low carbon austenite in the range of 5% to 50%, martensite in the range of 5% to 50% and graphite nodules in the range of approximately 10%. A small amount of carbide (cementite) may also be present from the original ductile iron microstructure. This phase is generally present in amounts less than 1%.

The advantage of camshafts formed of a ductile cast iron composition made according to this process is evident from stress and wear comparisons. A test fixture was fabricated to simulate engine operating conditions.

Sample camshafts were installed in the test fixture and cycled at 545 revolutions per minute (RPM) through several 100,000-mile test simulations. Valve springs were used having loading characteristics which imposed a variety of stresses on the camshaft lobes. Tests of camshafts 10 made of austempered iron according to the invention will sustain Hertzian stresses of approximately 253 KSI without exceeding a 0.002-inch maximum lobe wear limitation. This endurance stress limit proved to be higher than those for camshafts made from either martensitic ductile iron or conventional 0.5% carbon steel alloys.

TABLE 1 shows a comparison of camshaft lobe wear for camshafts made of a variety of materials. The values are derived from the 100,000-mile simulation for a maximum valve spring loading force of 298.8 lbs. Because the stress imposed on each lobe is a function of the modulus of elasticity and the spring loading force, the stresses induced on the camshafts are different for iron and steel for a given spring loading. For comparative purposes for the wear values given in TABLE 1, the maximum stress imposed on the iron camshafts was 253 KSI. As seen in the figure, austempered ductile iron camshafts made according to the invention have only 0.001 in. to 0.002 in. of wear as compared to 0.009 in. for 8650 bar stock steel (the top end non-carburized steel currently being used for roller follower camshafts), and 0.013 in. for 5150 bar stock steel.

TABLE 1

CAMSHAFT LOBE WEAR COMPARISONS AFTER 100,000-MILE SIMULATION FOR A MAXIMUM VALVE SPRING LOAD OF 298.9 LBS.

| CAMSHAFT MATERIAL | MAXIMUM WEAR (INCHES) |
|---|---|
| NON-AUSTEMPERED DUCTILE IRON | .010* |
| TITANIUM-NITRIDE NON-AUSTEMPERED DUCTILE IRON (ON COATED LOBES) | .002 |
| AUSTEMPERED DUCTILE IRON (FURNACE TREATMENT OF ENTIRE CAMSHAFT) | .002 |
| SELECTIVE AUSTEMPERED DUCTILE IRON (TORCH TREATMENT OF CAMSHAFT LOBES) | .001 |
| 1050 BAR STOCK STEEL (UNCARBURIZED) | .004* |
| 8650 BAR STOCK STEEL | .009 |
| 5150 BAR STOCK STEEL | .013 |
| 5150 VACUUM CAST STEEL | .008 |

*Tests terminated early due to rapidly wearing lobes

Camshafts 10 made according to the invention are cast in a conventional manner to form ductile iron. Although one embodiment of the invention includes premachining a camshaft which has not been heat-treated and then austempering the entire camshaft before its final machining, the preferred embodiment of the invention comprises selectively austempering only the camshaft lobes.

Selectively austempered camshafts 10 attain the required physical properties while reducing manufacturing time and cost. Because the high Hertzian stresses are imposed only on the lobes, only they need to be austempered. This method of austempering the camshafts 10 avoids interrupting the camshaft manufacturing line between the initial and final machining steps to austemper the parts as is required if the entire camshaft is furnace treated. For selectively austempered camshafts, all machining may be done at one time to the nonaustempered portions of the parts. The austempered camshaft lobes 14 may be ground as required.

According to this embodiment, as-cast ductile iron camshafts 10 are locally heated to the austenitizing temperature at the surface of the lobes by any suitable heating means such as flame torches, induction coils, plasma torches, electron beams, or lasers. The result is a layer of austempered ductile iron in the area where it is required. The remaining portions of the part remain in the form of as-cast ductile iron that can be easily machined. As seen in FIG. 5, the amount of lobe wear of selectively austempered ductile iron camshafts was actually slightly lower than the lobe wear of totally austempered ductile iron camshafts.

A selectively austempered ductile iron camshaft made according to the invention has been tested in an automobile engine. More particularly, the selectively austempered camshaft 10 was installed in a V-6 liter engine and subjected to a 500-hour durability test. The maximum Hertzian stress imposed on the camshaft was 230 KSI. In this test, the maximum amount of wear on the camshaft was 0.0004 inches.

The test results demonstrate the ability of austempered iron camshafts 10 to withstand high Hertzian stresses and to show little wear for the periods required to be used satisfactorily in automobiles or other engines.

While the invention has been described in connection with preferred embodiments thereof, it will be understood that we do not intend to limit the invention to those embodiments. To the contrary, we intend to cover all alternative modifications and equivalents as may be included within the spirit and scope of the invention as defined by the appended claims.

I claim:

1. A ductile cast iron camshaft made according to the process of:

casting into an elongated shaft a cast iron composition comprising by weight percent:
3.40–3.90 carbon
1.90–2.70 silicon
0–1.40 manganese
0–1.5 molybdenum
0–0.8 phosphorous
0–2.0 copper
balance iron
said elongated shaft having a plurality of eccentric lobes spaced therealong;

selectively heating at least some of the lobes in non-austempered condition to a temperature in the range of 1450° F. to 2100° F. to austenitize only surface portions of said lobes while maintaining the remainder of said shaft in non-austempered condition.

quenching the heated lobes rapidly to a bainite transformation temperature to essentially prevent the formation of pearlite in the heated lobe portions;

holding the quenched lobe portions at the bainite transformation temperature for a time sufficient to transform at least a substantial portion of the austenite into bainite while avoiding the formation of pearlite;

cooling the quenched lobe portions to room temperature to further transform some of the remaining austenite to bainite or martensite;

wherein the camshafts have selectively hardened lobes which have a microstructure comprising by volume 25% to 75% bainite, 5% to 50% martensite, 5% to 50% unreacted low-carbon austenite, approximately 10% graphite nodules, and less than 1% cementite.

2. A ductile cast iron camshaft made in accordance with the process comprising the steps of:

casting into an elongated shaft a cast iron composition comprising by weight percent:

3.40–3.90 carbon
1.90–2.70 silicon
0–1.40 manganese
0–1.5 molybdenum
0–0.8 phosphorous
0–2.0 copper
balance iron said elongated shaft having a plurality of eccentric lobes spaced therealong;

selectively heating at least some of the lobes in non-austempered condition to a temperature in the range of 1450° F. to 2100° F. to austenitize only surface portions of said lobes while maintaining the remainder of said shaft in non-austempered condition;

quenching the heated lobes rapidly to a bainite transformation temperature to essentially prevent the formation of pearlite in the heated lobe portions;

holding the quenched lobe portions at the bainite transformation temperature for a time sufficient to transform at least a substantial portion of the austenite into bainite while avoiding the formation of pearlite;

cooling the quenched lobe portions to room temperature to further transform some of the remaining austenite to bainite or martinsite;

whereby camshafts are formed with selectively hardened lobes.

3. A ductile cast iron camshaft according to claim 2 wherein at least portions of the unhardened remainder of the shaft are machined subsequent to the cooling step.

4. A ductile cast iron camshaft according to claim 3 wherein portions of the austempered lobes are ground subsequent to the cooling step.

5. A camshaft according to claim 2 wherein the austenitizing temperature is in the range of 1500°–2000° F.

6. A camshaft according to claim 5 wherein the time of the austenitizing step is in the range of 1 second to 100 seconds.

7. A camshaft according to claim 6 wherein the lobes are quenched to the bainite transformation temperature within 180 seconds.

8. A camshaft according to claim 7 wherein the bainite transformation temperature is in the range of 450°–850° F.

9. A camshaft according to claim 7 wherein the lobes are held at the bainite transformation temperature for a time of 10 minutes to 240 minutes.

10. A camshaft according to claim 9 wherein the lobes are held at the bainite transformation temperature for a time of 115 to 125 minutes.

11. A camshaft according to claim 8 wherein the bainite transformation temperature is in the range of 465°–485° F.

12. A camshaft according to claim 2 wherein the delay between the heating and quenching steps is less than 60 seconds.

13. A camshaft according to claim 2 wherein copper is present in the amount of 0.8 to 2.0 percent and molybdenum is present in the amount of 0.2 to 1.5 percent.

14. A camshaft according to claim 2 wherein carbon is present in the range of 3.50% to 3.80%.

15. A camshaft according to claim 2 wherein silicon is present in the range of 2.10% to 2.40%.

16. A camshaft according to claim 2 wherein manganese is present in the range of 0.00% to 0.30%

17. A camshaft according to claim 2 wherein molybdenum is present in the range of 0.2% to 1.5%.

18. A camshaft according to claim 2 wherein phosphorous is present in the range of 0.00% to 0.05%

19. A camshaft according to claim 2 wherein cooper is present in the range of 0.8% to 2.0%.

20. A camshaft according to claim 2 wherein the cast iron composition further includes 0.030 to 0.065% magnesium by weight.

21. A camshaft according to claim 2 wherein the percentage of molybdenum by weight is in the range of 0.2 to 0.6.

22. A camshaft according to claim 21 wherein the percentage of copper by weight is in the range of 0.8 to 1.2.

23. A camshaft according to claim 2 wherein the percent by weight of copper is in the range of 0.8 to 1.2.

24. A camshaft according to claim 2 wherein the cast iron composition further comprises at least one element selected from the group consisting of magnesium, nickel, chromium, aluminum, titanium and tin.

* * * * *

UNITED STATES PATENT AND TRADEMARK OFFICE

CERTIFICATE OF CORRECTION

PATENT NO. : 5,028,281

DATED : July 2, 1991

INVENTOR(S) : WILLIAM J. HAYES et al.

It is certified that error appears in the above-identified patent and that said Letters Patent is hereby corrected as shown below:

Column 8, claim 19, line 32, "cooper" should be --copper--.

Column 8, claim 24, lines 47 and 48 should be --selected from the group consisting of by weight percentage 0.03 to 0.065% magnesium, 0.0 to 3.0% nickel, 0.0 to 0.50% chromium, 0.0 to 0.10% Al, 0.0 to 0.1% titanium and 0.0 to 0.2% tin.--

Signed and Sealed this

Seventeenth Day of November, 1992

*Attest:*

DOUGLAS B. COMER

*Attesting Officer*

*Acting Commissioner of Patents and Trademarks*